United States Patent [19]

Boner

[11] Patent Number: 4,556,105

[45] Date of Patent: Dec. 3, 1985

[54] PARALLEL HEAT EXCHANGER WITH INTERLOCKING PLATE ARRANGEMENT

[76] Inventor: Alan H. Boner, 140 W. 16th Ave., Eugene, Oreg. 97401

[21] Appl. No.: 544,824

[22] Filed: Oct. 24, 1983

[51] Int. Cl.[4] ..... F28D 7/02

[52] U.S. Cl. ..... 165/165; 165/164

[58] Field of Search ..... 165/165, 166, 164

[56] References Cited

U.S. PATENT DOCUMENTS

| | | | |
|---|---|---|---|
| 1,740,145 | 12/1929 | Bates | 165/166 X |
| 2,019,351 | 10/1935 | Lathrop | 165/165 |
| 2,937,856 | 5/1960 | Thomson | 165/66 |
| 2,959,400 | 11/1960 | Simpelaar | 165/166 |
| 3,581,649 | 6/1971 | Rauenhorst | 98/33 |
| 4,184,538 | 1/1980 | Rauenhorst | 165/66 |
| 4,343,355 | 8/1982 | Goloff et al. | 165/166 |

FOREIGN PATENT DOCUMENTS

| | | | |
|---|---|---|---|
| 416331 | 7/1925 | Fed. Rep. of Germany | 165/166 |

*Primary Examiner*—Stephen F. Husar

*Attorney, Agent, or Firm*—Klarquist, Sparkman, Campbell, Leigh & Whinston

[57] ABSTRACT

A parallel plate air-to-air counterflow heat exchanger employs a parallel array of spaced plates of similar elongated hexagonal shape. A pair of inlet and outlet ducts is connected to each lengthwise pointed end of the array. Each duct communicates with alternate airways via rectangular openings staggered on opposite sides of the ends of the array. The ducts extend parallel to a lengthwise midline of the array to enable air flow through the heat exchanger and ducts with minimal change of momentum and turbulence. The plates each have parallel widthwise margins which are oppositely rolled to different, complementary radii and adjacent plates are mutual mirror images. The plate margins nest together to interconnect the plates and enclose one side of each airway. A housing around the array encloses the opposite side of each airway. Opposite margins of the pointed end portions of the plates are rolled oppositely to interlock the plates, to define the staggered rectangular openings of their respective adjoining plate margins, and smoothly to divide and recombine the airflows into and out of each airway. A standard plate size is used and the number of plates is varied to accommodate different total volumes of airflow.

16 Claims, 11 Drawing Figures

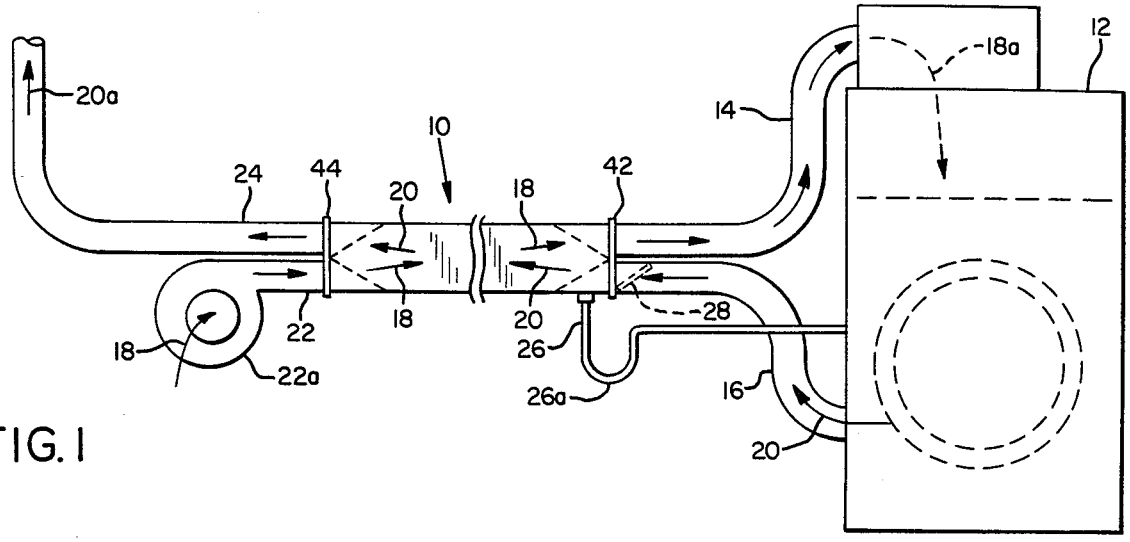
FIG. 1
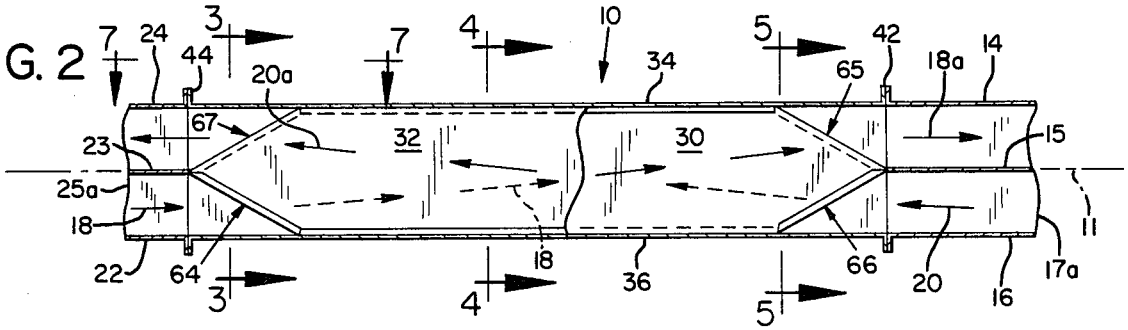
FIG. 2
FIG. 3
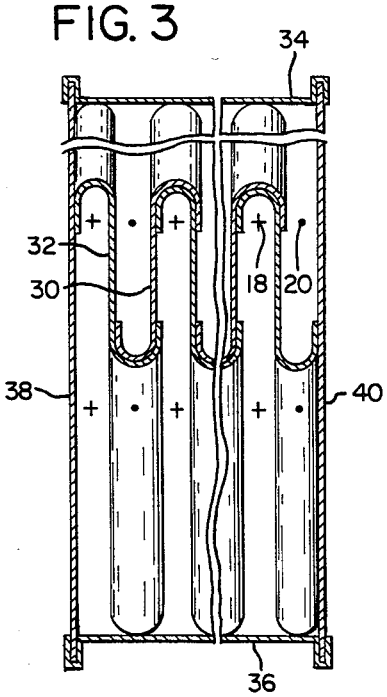
FIG. 4
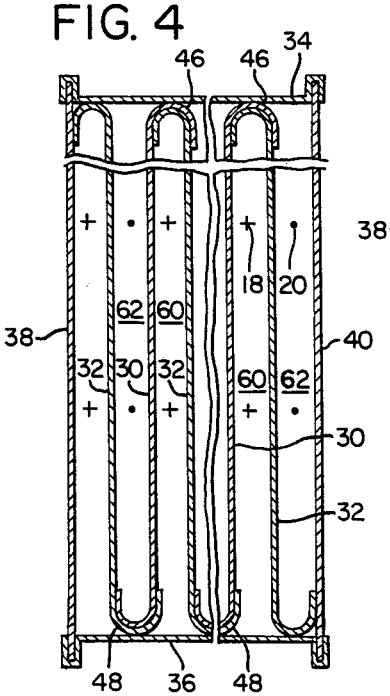
FIG. 5
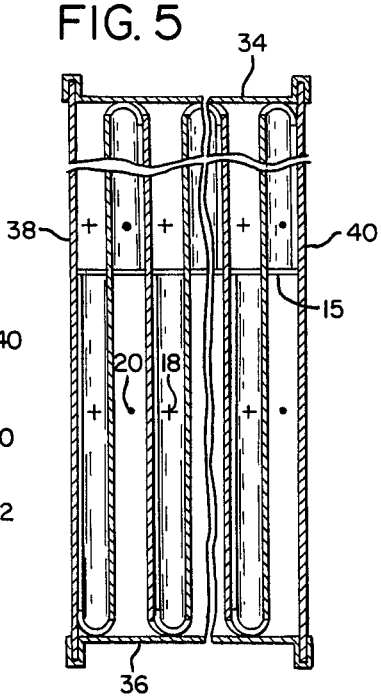

PARALLEL HEAT EXCHANGER WITH INTERLOCKING PLATE ARRANGEMENT

BACKGROUND OF THE INVENTION

This invention relates generally to heat exchangers and more particularly to the structure of plate-type air-to-air heat exchangers. Numerous types of heat exchangers have been utilized to effect the transfer of heat from one stream of gases to another. As heat energy becomes increasingly expensive, a wide range of applications is being found for air-to-air heat exchangers. Many of these applications involve a process or application that contaminates the air, requiring that it be exhausted after being heated and that fresh air be supplied and heated. Examples of this situation include the traditional single pass of air through clothes dryers and forced air heated buildings, in which fresh, ambient air of relatively low humidity is heated and circulated through the dryer or building. As the air is circulated, it is humidified and acquires solid contaminates such as dust and lint. Conventionally, the air is then exhausted to the outside, with a resultant loss of its energy content.

It would be preferable to recover a portion of this energy by heat transfer to the incoming replacement air. Unfortunately, most prior attempts to do so have proven economically infeasible. It is possible to design a heat exchanger having a relatively high heat transfer efficiency, measured only in terms of heat recovered. However, the effectiveness of such heat transfer has proven marginal at best when measured additionally in terms of the value of the heat recovered in proportion to the cost of the apparatus to effect recovery.

A primary problem in the design of air-to-air heat exchangers is to transfer as much input heat as possible from the exhaust airflow path to the incoming airflow path while minimizing the energy required to pump the air through the system. A preferred form of heat exchanger for air-to-air heat transfer is the plate-type counterflow heat exchanger. Plate type parallel and cross-flow heat exchangers have also been used, such as disclosed in U.S. Pat. No. 2,959,400 to Simpelaar, but are less efficient than counterflow heat exchangers. The counterflow arrangement yields higher heat transfer efficiencies but heretofore has required complex and awkward header arrangements such as those of U.S. Pat. No. 2,019,351 to Lathrop, U.S. Pat. No. 2,937,856 to Thomson, and U.S. Pat. Nos. 3,581,649 and 4,184,538 to Rauenhorst.

Such arrangements create bends or folds in the airflow path which cause momentum changes in the airflows. Consequently, added pumping energy is required to move the airflows through the heat exchanger. Abrupt changes of direction also encourage accumulations of solid contaminants within the heat exchanger. Such accumulations lead to plugging thereby reducing the efficiency of the heat exchanger and further increasing its operating cost due to impedence of the airflows through the device. Additionally, such devices are extremely difficult to clean. As a result, a primary design goal for counterflow heat-type exchangers has been to attain a plate arrangement and header configuration which yields high heat transfer efficiencies and yet minimizes the required fan energy, to compensate for pressure drop across the heat exchanger. The need to minimize bending of airflows and changes of cross-sectional area have also been recognized. However, no prior design of parallel plate-type heat exchanger has succeeded in achieving these goals.

Also of importance is the mass producibility of the device, particularly the ease of manufacturing and assembling the plates and headers. U.S. Pat. No. 2,937,856 utilizes complicated stampings. U.S. Pat. No. 2,019,351 utilizes a complicated enclosure and seals. Physical size changes in most type of heat exchangers for each application require custom design and manufacturing of many sizes of the various components. Consequently, the design, manufacture and assembly of heat exchangers is too expensive for many applications in which the value of heat recovered is low in proportion to the cost of recovery.

Accordingly, a need remains for an air-to-air heat exchanger which is both efficient and cost effective, even for relatively low-value energy recovery applications, such as to hot air dryers and forced air heating systems in buildings.

SUMMARY OF THE INVENTION

One object of the invention is to provide an improved plate-type air-to-air heat exchanger.

A second object of the invention is to arrange a counterflow plate-type heat exchanger to maximize heat transfer efficiency with a minimum of pressure losses through the heat exchanger and duct airways.

Another object is to minimize the susceptibility of air-to-air plate-type heat exchangers to accumulations of contaminants, and to make such heat exchangers easy to clean.

A further object is to simplify the design of air-to-air, plate-type heat exchangers so that they can be inexpensively manufactured and assembled.

Yet another object is to provide a modular design of air-to-air, plate-type heat exchanger which can be readily changed in size, without redesigning the size and configuration of components, to handle different volumes of airflow.

An air-to-air plate heat exchanger in accordance with the invention comprises a plurality of similar elongated plates arranged in a parallel array and spaced apart to define one or more pairs of adjoining enclosed elongated passageways. Each pair includes an incoming airway and an exhaust airway. Each plate in the array has pointed opposite ends, each end terminating at an apex along a widthwise midline extending lengthwise of the passageways. A first means defining an air inlet conduit is connected at one end of the array of plates, on one side of the midline, for conveying air into one of the airways. A second means defining an air discharge conduit is similarly connected to a diagonally opposite end of the array of plates.

In a preferred embodiment, in which the plates are uniformly spaced, the midline is identical to a widthwise centerline of the plates. However, the midline is not identical to the centerline in the case of skew-symmetric plates. In such plates, each pointed end is defined by two edges of different lengths equal to the lengths of diagonally opposite edges of the opposite end of the plates. The latter arrangement might be used to transfer heat between gas flows of different densities or flow rates through adjacent airways of different plate spacings.

In one aspect of the invention, the inlet and discharge conduits extend parallel to the midline so that airflows from the inlet conduit through one airway in isolation from the other airway and out the outer discharge conduit with a minimum change of momentum. Both airways have separate air inlet and outlet ducts connected thereto, all preferably extending parallel to the airways. Alternate passageways in the heat exchanger are connected to one of the conduits while an intervening passageway is closed to communication with that conduit by an end closure means extending along one side of the pointed end of the array. The end closure means shunts an airflow widthwise of the intervening passageway to an opposite side of the midline. The latter passageway communicates with the adjoining conduit through a staggered opening on the opposite side of the pointed end of the plate array. The end closure means is preferably shaped to streamline the airflow into and out of the plate array to minimize turbulence of the air entering and exiting the passageways.

A second aspect of the invention is that the conduits are sized to provide each conduit with a cross-sectional area equal to the total cross-sectional area of the airways to which such conduit is connected. The openings into and out of the passageways preferably have a dimension parallel to the plates which equals the width of the passageway, measured widthwise of the plates.

Another aspect of the invention is a heat exchanger plate arrangement, wherein a first plate comprises a rectangular planar elongated plate member having parallel opposite widthwise edges and lengthwise ends which are diagonally truncated so that the plates are pointed at each end. The end portions of the plate members have terminal edges which obliquely intersect the widthwise edges of the plate member and intersect at an apex along the lengthwise midline of the plate member. Interconnecting means connect the first plate along one widthwise edge to an adjoining edge of a second plate and along the opposite widthwise edge to an adjoining edge of a third plate. The second and third plates are spaced from the first plate on opposite sides thereof. Preferably, the interconnecting means comprise a marginal portion of each widthwise edge of the plate member which is folded out of the plane of the plate member to nest with complementary folded marginal portions of the second and third plates. The size of the folded marginal portions determines the spacing of the plates. Preferably, the marginal portions are rolled in opposite directions so as to define in cross-section an S-shape in one plate and a reverse S-shape in the other plate. The pointed end portions likewise have their edges rolled in opposite directions, diagonally opposite edge portions being rolled in the same direction so that, upon assembly, such plates are all interlocked together.

For use in transferring heat from the exhaust of a hot air dryer, which contains small solid contaminates even after passage through a filter, a preferred plate spacing is about $\frac{1}{4}''$ and a preferred heat exchanger length is about 54".

The foregoing and other objects, features and advantages of the invention will become more readily apparent from the following detailed description which proceeds with reference to the accompanying drawings.

BRIEF DESCRIPTION OF THE DRAWINGS

FIG. 1 is a front elevational view of a hot air clothes dryer incorporating an air-to-air counterflow plate heat exchanger in accordance with the invention.

FIG. 2 is an enlarged vertical-lengthwise sectional view of the heat exchanger portion of FIG. 1, portions of the interior plate structure being cut away to show airflows.

FIG. 3 is a transverse sectional view taken along line 3—3 in FIG. 2.

FIG. 4 is a transverse sectional view taken along line 4—4 in FIG. 2.

FIG. 5 is a transverse sectional view taken along line 5—5 in FIG. 2.

DETAILED DESCRIPTION

Figure 6:
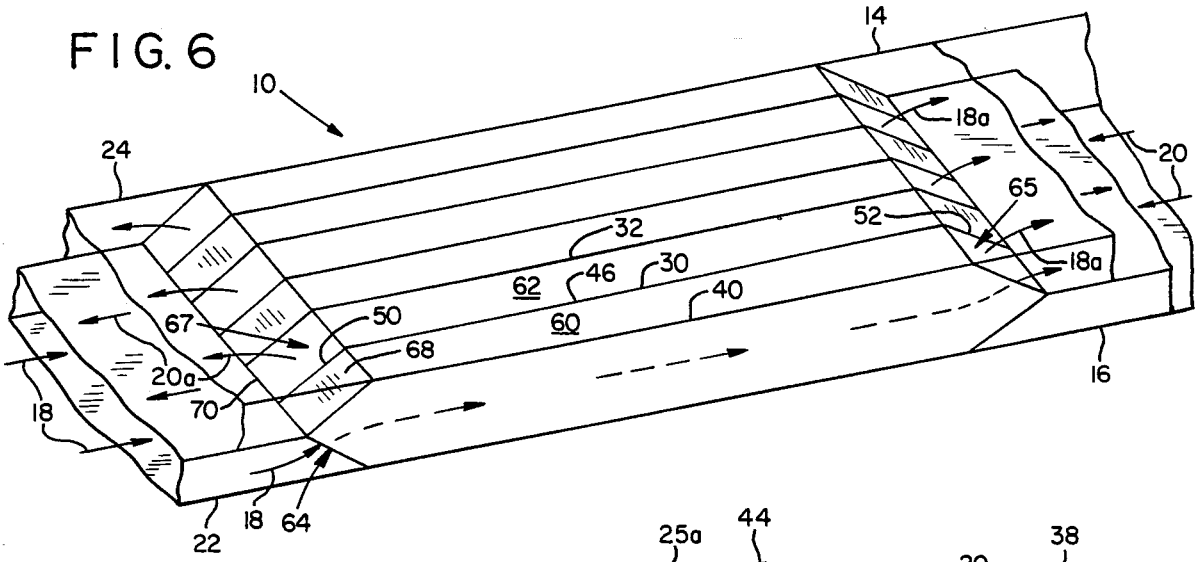
FIG. 6 is a schematic perspective view of the heat exchanger of FIGS. 1 and 2.

Referring to FIG. 1, an air-to-air counterflow plate-type heat exchanger 10 in accordance with the invention is connected at one end to a conventional, industrial-type clothes dryer 12 via a fresh air inlet duct 14 and a warm air discharge duct 16. These ducts or conduits are connected to the dryer in conventional fashion to convey warmed fresh air **18*a* into the dryer through duct 14 and to discharge warm, moist exhaust air 20 from the dryer via duct 16. At the opposite end of heat exchanger 10 from the dryer, an incoming air duct 22 and fan 22*a* induces fresh ambient air 18 into the heat exchanger, to flow ultimately into the dryer through duct 14 as warmed fresh air 18*a*. An exhaust outlet duct 24 is connected to the heat exchanger above the fan for conveying to an outside outlet exhaust air 20*a*, cooled by the transfer of heat in the heat exchanger into the incoming fresh air 18. The duct pairs 14, 16 and 22, 24 are horizontally divided adjacent their connections to the heat exchanger by common horizontal divider walls 15 and 23, respectively. A condensate drain tube 26 with a water trap elbow 26*a* is connected to the underside of discharge duct 16 adjacent heat exchanger 10. Tube 26 collects moisture condensed from the moist exhaust air and conveys it to any suitable drain outlet, such as to a drain pipe serving an adjacent washing machine (not shown). An air filter 28 is positioned in exhaust air duct 16** between the dryer and the heat exchanger to filter sizeable solid contaminats, such as dust and lint, out of the exhaust air flow before it enters to heat exchanger.

The overall structure of heat exchanger 10, and its manner of interconnection to ducts 14, 16 and 22, 24, is best understood by reference to the schematic diagram of FIG. 6 and the longitudinal sectional view of FIG. 2. Th heat exchanger comprises an array of similar parallel spaced heat exchanging plates 30, 32. The array of plates 30, 32 is housed within a sheet metal enclosure defined by top and bottom walls 34, 36 and opposite side walls 38, 40, best seen in FIGS. 3–5. Surrounding connector flanges 42, 44 (FIG. 1) connect the heat exchanger at opposite ends of the housing to the pairs of ducts 16, 18 and 22, 24. A portion of the pairs of ducts immediately adjacent each end of the heat exchanger extends parallel to the walls of the heat exchanger housing. The common walls 15, 23 of such ducts are aligned with a midline 11 extending lengthwise of the heat exchanger. In the particular embodiment shown, wherein the heat exchanger plates are symmetrical in shape, midline 11 is the same as the lengthwise centerline of the plates of the heat exchanger.

Figure 9:
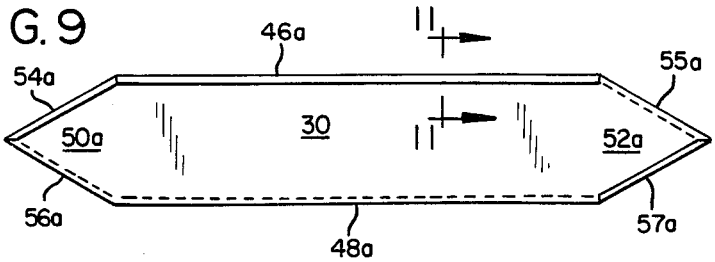
FIG. 9 is a plan view showing the plate of FIG. 8 rolled along its margins to form a right hand plate.
Figure 10:
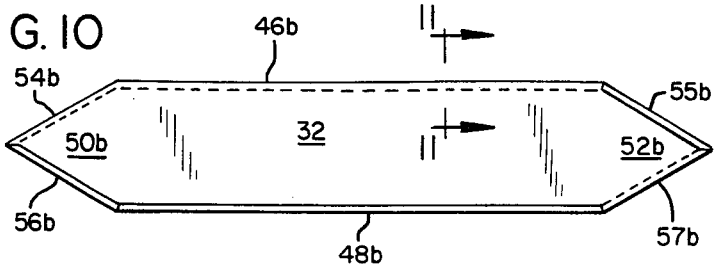
FIG. 10 is a plan view showing the plate of FIG. 8 rolled along its margins to form a left hand plate.

Plates 30, 32 are all similarly sized and shaped in accordance with the shape of an elongated hexagon, as better seen in FIGS. 9 and 10. Thus, each plate has a pair of elongated opposite edges 46, 48 defining the widthwise dimension of the plates. End portions 50, 52 of each plate are diagonally truncated to define pointed ends of the plates. The end portions 50, 52 each have a diagonal upper edge 54, 55 and a diagonal lower edge 56, 57, repsectively. The diagonal edges each intersect their respectively adjacent widthwise edges 46, 48 of the plate body at an angle 58, preferably of 30°. The diagonal edges of each end of plates 30, 32 also intersect an an apex at an angle of 60°.

The plates 30, 32 and housing side walls 38, 40 define pairs of airways 60, 62 carrying opposite direction airflows 18, 20, respectively. Staggered on upper and lower sides of the ends 50, 52 of the plate array are alternating inlet openings 64, 66 and discharge openings 65, 67. Openings 65, 66 are positioned on the upper and lower sides, respectively, of the end of the heat exchanger adjacent the dryer. Openings 64, 67 are similarly located at the end remote from the dryer. Alternating between the end openings on each upper and lower side of the pointed ends of the plate array are staggered end closure elements 68, 70, which close off airflow communication between alternate airways and one of the ducts. For example, as shown in FIG. 6, opening 64 provides airflow communication between airway 60 and conduit 22 so that incoming air 18 can flow from the duct into the heat exchanger on the underside of the leftward pointed end of the heat exchanger. Similarly, opening 66 provides airflow communication between airway 62 and duct 24 so that exhaust air 20 can flow from the heat exchanger into the exhaust duct. Closure means 68 prevents air from flowing out of airway 60 into duct 24. A similar closure means 70 on the underside of the end of airway 62 similarly prevents airflow from airway 62 into duct 22.

Consequently, fresh ambient air 18 flowing in through duct 22 enters openings 64, flows through airways 60, and flows out of openings 65 at the opposite end of the heat exchanger into duct 14 (now as heated fresh air 18*a*) to be carried by duct 14 into the dryer. Simultaneously, warm moist exhaust air 20 flows from the dryer via duct 16 into the heat exchanger through inlet openings 66 staggered along the underside of end 52 of the array of plates. The warm air then flows through airways 62, losing heat through plates 30, 32 to the fresh air in airways 60. Finally, the exhaust air is discharged into conduit 24 from the heat exchanger through openings 67, staggered along the upper side of end 54 of the array of plates, at a reduced temperature due to the loss of heat to the incoming fresh air.

Figure 8:
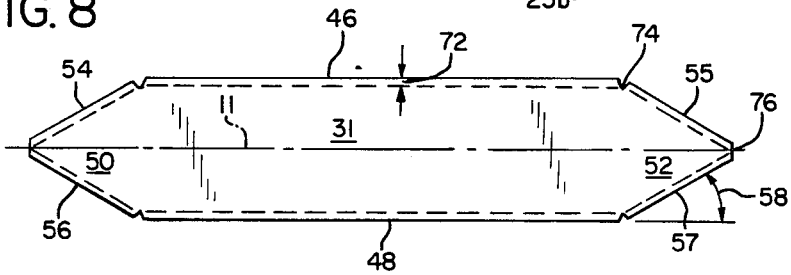
FIG. 8 is a plan view of a single plate of the type used in the heat exchanger of FIG. 1, shown at an intermediate stage of fabrication.

FIGS. 8–11 show the manufacturing development and assembly of plates 30, 32 in further detail. Initially, a plate blank 30 is stamped or cut out of flat sheet metal to the shape previously described generally and specifically as shown in FIG. 8. An excess narrow marginal portion 72 is provided along each edge of the plate. The marginal portion is notched at each intersection 74 between the widthwise edges 46, 48 and the diagonal edges 54–57 of the end portions of the plate. The marginal portions meet at the point or apex of each end of the plate to form a blunt end 76. The blunt ends can be slotted along midline 11 to receive a marginal end portion of the common walls 15, 23.

Figure 11:
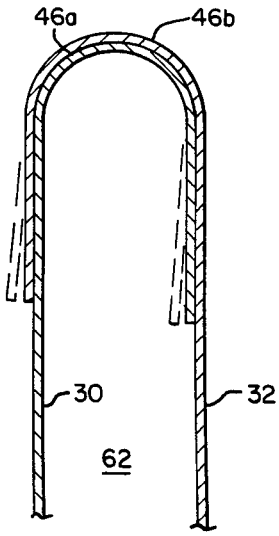
FIG. 11 is a cross-sectional view taken along lines 11—11 in FIGS. 9 and 10, showing adjoining portions of the right and left hand plates, nested together to interconnect the plates and define a side of an airway of the heat exchanger of FIG. 1.

Referring to FIGS. 9 and 10, the marginal portions of plate blank 31 of FIG. 8 are rolled as next described to form mirror image right and left hand plates 30, 32. In FIG. 9, the right hand plate 30 has its upper widthwise margin 46*a* rolled clockwise, as shown in FIG. 11. Its lower widthwise marginal portion 48*a* is likwise rolled clockwise to the opposite side of the plate. Referring to FIG. 10, the upper and lower margins, 46*b*, 48*b* of plate 32 are rolled in the opposite directions of margins 46*a*, 48*a*.

The marginal portions of the plates are rolled in semicircles of different radii so that adjoining edges 46*a*, 46*b* of plates 30, 32 can be nested together, as shown in FIG. 11. The rolled margins thereby connect plates 30, 32 together and enclose one side of airway 62 therebetween. Each plate 30 has, in cross-section, an S-shape and each plate 32 a reverse S-shape, as best seen in FIG. 4. The lower marginal portions 48*a*, 48*b* are likewise rolled to different radii so that each plate has an edge portion of the larger radius and an edge portion of the smaller radius. The lower edge portion 48*b* of plate 32 is thus sized to receive the lower edge portion 48*a* of a second right hand plate 30.

An array of three such plates 30, 32, 30 nested together thus defines a pair of airways 60, 62 which are enclosed along opposite edges 46, 48 to segregate the opposite incoming and exhaust airflows 18, 24. This arrangement can be repeated indefinitely to increase the lateral width of the plate array as needed to match the volume of airflow which needs to be processed by the heat exchanger.

Referring back to FIGS. 9 and 10, the upper diagonal edges 54, 55 of the end portions of the plates are rolled in directions opposite from one another and in accordance with the same radius as their respective adjoining widthwise edge of the plate body. Accordingly, upper diagonal edge 54*a* of plate 30 is rolled in the same direction and at the same radius as upper widthwise edge 54*a* and upper diagonal edge 55*a*, at the opposite end of plate 30 is rolled in the opposite direction of edge 46*a* but in accordance with the same radius. Upper edges 54*b*, 55*b* of plate 32 are rolled in accordance with the same radius as widthwise edge 46*b*, but diagonal edge 55*b* is rolled in the opposite direction. Similarly, the lower diagonal edges 56*a*, 57*a* are rolled to the same radius as widthwise edge 48*a*, with edge 57*a* being oppositely rolled, and the lower edges 56*b*, 57*b* of plate 32 are rolled in the opposite directions in accordance with the smaller radius of widthwise edge 48*b*.

Consequently, in the plate array of FIGS. 3 and 5, the rolled diagonal edges of different radii nest together to interconnect the end portions of the plates. Because each plate has diagonal edge portions rolled in opposite directions, along both the upper and lower edges of the plate, the plates interlock with adjoining plates on both sides. As a result, a plurality of such plates fitted together to form an array interlock and thereby avoid the necessity of welding, riveting or screwing the plates together.

To fit right and left hand plates together, the plates are initially positioned diagonally, with the left hand plate atop the right hand plate and end 52*b* spaced below and directed toward edge 46*a*. Then, the left hand plate 32 is slid parallel to right hand plate 30 toward end portion 52*a* to nest the upper edge portion 46*b* of the left hand plate within the upper margin 46*a* of the right hand plate and to nest the lower diagonal edge 57*b* of plate 32 into the lower diagonal edge 57*a* of plate 30. A second right hand plate 30 is then positioned atop the left hand plate, with its end portion 52*a* spaced above and directed toward the lower margin 48*b* of plate 32. It is then slid rightwardly until margin 48*a* is received in margin 48*b* and margin 55*a* is received in margin 55*b*. This process is repeated until a sufficient number of plates have been assembled into an array to accommodate the volume of air to be processed for a particular situation.

Figure 7:
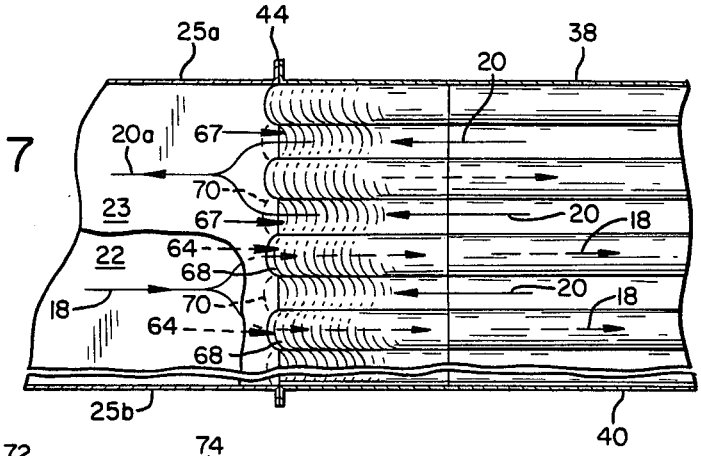
FIG. 7 is a top plan view taken along line 7—7 in FIG. 2, portions of the duct and housing being cut away to show interior details of the heat exchanger, and the manner of division and recombination of incoming and exhaust airflows.

Referring to FIG. 7, it can be seen that the rounded diagonal edges at the pointed ends of th plates provide curved or rounded shapes at the ends of the heat exchanger. These shapes streamline the incoming airflow 18 as such airflow divides around the ends of the plates to enter openings 64 on the underside of the end of the plate array. Similarly, such shape streamlines the recombination of airflows 20*a* flowing from openings 67 along the upper side of the end of the plate array. Although a semicircular shape of such ends is utilized for simplicity, one skilled in the art would recognize that the air foil characteristics of the plate ends can be further optimized.

It is preferable to make the spacing of the plates as narrow as possible. It should not be apparent that the radii of the edges of the plates determines plate spacing. By increasing such radii, plate spacing is increased and conversely by reducing the radius, plate spacing is reduced. For use in exchanging heat between airflows wherein one airflow contains solid contaminants, I have discovered that there is a minimum plate spacing, below which build-up of contaminants occurs and rapidly reduces the efficiency of the heat exchanger. For use in a hot air dryer system, I have found that that minimum spacing is about ¼". Accordingly, for such application the preferred spacing is 0.28". The plate spacing affects the efficiency of heat exchange in an inverse functional relationship to the length of the heat exchanger. I have found that the most effective heat transfer occurs in my heat exchanger, with the plates spaced 0.28" apart, when the length of the heat exchanger along edges 46, 48 is about 54". A preferred width for the plates is 11½".

Referring back to FIGS. 2 and 6, the airflows from the ducts into and out of the heat exchanger follow a nearly straight line. This arragement minimizes changes of momentum of the gases flowing through the heat exchanger and thereby reduces resultant pressure losses compared to prior forms of counterflow heat exchangers. Also, each airflow path has a constant cross-sectional area through the ducts and heat exchanger, and thereby avoids contacting or expanding the gases and thus reduces resistance losses in pressure. Particularly important is the fact that the dimensions of the openings 64, 65, 66, 67 are the same as the vertical sectional dimensions of the passageways 60, 62. In other words, edges 54–57, when rolled, have a length twice the widthwise dimension of the passageways within the plates. The ducts have a vertical dimension equal to half of the vertical width of the passageways, but the useful horizontal dimension of such ducts is twice as great, because only half of the airways feed into each duct. Finally, airflow losses due to eddies and turbulence are minimized by the rolled edges 54–57 which streamline the airflows as they divide and recombine upon entering and leaving the heat exchanger.

Having illustrated and described the principles of my invention in a preferred embodiment, it should be readily apparent that the invention can be modified in arrangement and detail without departing from such principles. Accordingly, I claim all modifications coming within the scope and spirit of the following claims:

I claim:

1. An air-to-air parallel plate counterflow heat exchanger comprising:

a plurality of similar elongated plates of a predetermined width arranged in a parallel array and spaced apart to define at least one pair of adjoining enclosed elongated passageways including an incoming airway and an exhaust airway arranged for exchanging heat between counterflowing incoming and exhaust airflows, each plate having pointed opposite ends each terminating at an apex along a widthwise midline extending lengthwise of the passageways;

first means defining an air inlet conduit connected at one end of the array on one side of said midline for conveying air into one of the airways; and second means defining an air discharge conduit connected at an opposite end of said plates on an opposite side of said midline for conveying air from said one airway;

the inlet and discharge conduits extending parallel to said midline so that air flows from the inlet conduit in a direction parallel to said midline into said one airway, through said one airway in isolation from the other airway, and out of the one airway in a direction parallel to said midline into the discharge conduit with a minimum change of momentum.

2. A heat exchanger according to claim 1 in which both of said airways have separate air inlet and outlet conduits connected thereto in parallel on opposite sides of the midline and at opposite ends of the array of plates.

3. A heat exchanger according to claim 1 in which said array of plates defines at least two pairs of said passageways, the means defining each conduit being connected to provide airflow communication to alternate passageways defining the airway, an intervening passageway including end closure means closing the intervening passageway to communication with the conduit along the one side of the pointed end to which the conduit is connected and shunting an airflow within the intervening passageway widthwise to an opposite side of the midline from the side to which the conduit is connected and for dividing an airflow entering the passageways from the inlet conduit and combining two airflows exiting the airways into the discharge conduit, the end closure means being rounded concavely within each passageway and convexly outside each passageway to streamline the airflows to minimize turbulence upon entering and exiting the passageways.

4. A heat exchanger according to claim 1 in which each conduit has a rectangular cross-section defined by a first dimension parallel to the plates equal to one-half of the width of the plates and a second dimension normal to the plates equal to a sum of the spacing of the plates defining two adjoining passageways, including the passageway to which the conduit is connected.

5. A heat exchanger according to claim 1 in which one of the incoming and exhaust airflows includes solid contaminants and the plates are spaced at at least a minimum spacing for said contaminants to flow through the airway with a minimum of accumulation on the plates;

the plates having a length which is a function of said minimum spacing determined to maximize heat exchange.

6. A heat exchanger according to claim 5 for transferring heat from heated exhaust air from a clothes dryer into incoming cool air, in which the minimum spacing is about one-quarter inch.

7. A plate arrangement for use in a parallel array of plates in a plate-type counterflow heat exchanger, wherein a first plate comprises:

a rectangular planar elongated plate member having parallel opposite widthwise edges and opposite lengthwise end portions diagonally truncated to define terminal edges obliquely intersecting the widthwise edges of the plate member and intersecting at an apex along a lengthwise midline of the plate member to define oppositely directed pointed ends of the plate; and interconnecting means for connecting the first plate along one widthwise edge to an adjoining edge of a second said plate and along the opposite widthwise edge to an adjoining edge of a third said plate, the second and third plates being spaced from the first plate on opposite sides thereof to define first and second passageways for counterflows of air;

the interconnecting means comprising a marginal portion formed along each widthwise edge of the plate member, folded out of the plane of the plate member, one marginal portion folded in one direction along one widthwise edge to nest within a complementary folded marginal portion of the second plate and the other marginal portion folded in the opposite direction along the opposite widthwise edge to receive a complementary folded marginal portion of the third plate, the marginal portions of each plate defining substantially parallel sides of airways for containing parallel counter-airflows in the passageways.

8. A plate arrangement according to claim 7 in which one of the pointed end portions has a first marginal portion along one terminal edge adjoining said one marginal portion of the plate member, which is folded in the same direction as said one marginal portion to define a first end closure at one end of the first passageway, and the opposite pointed end portion has a second marginal portion along one terminal edge adjoining said one marginal portion, which is folded in the opposite direction to define a second end closure at the opposite end of the second passageway, the marginal portions of the body and end portions on the opposite side of the midline being oppositely folded to define a mirror image of the one marginal portion of the body and the first and second marginal portions of the end portions and to form a third end closure at the opposite end of the first passageway.

9. A plate arrangement according to claim 8 in which the second and third plates first are shaped to form mirror images of the plate and said marginal portions are rolled in opposite directions so as to define an S-shape such that upon assembly the first, second and third plates are interlocked by said rolled marginal portions.

10. A plate arrangement according to claim 8 in which the second and third plates are shaped to form mirror images of the first plate so that when the plates are assembled in said array, staggered openings are formed between alternate pairs of plates on opposite sides of said pointed ends.

11. A plate arrangement according to claim 7 in which the second and third plates are shaped to form mirror images of the first plate so that, when said plates are assembled in said array, the nested folded margins space the plates apart and enclose one side of an airway between each pair of plates.

12. A heat exchanger including an array of plates in accordance with the arrangement of claim 7, including a housing surrounding the plate member of the plates to enclose an opposite side of said airways.

13. A plate arrangement according to claim 7 in which said marginal portions of the first plate are rolled in opposite directions to define in cross-section an S-shape.

14. A plate arrangement according to claim 13 in which one of the marginal portions of each plate is rolled in accordance with a semicircle of a first radius and the other marginal portion is rolled in accordance with a semicircle of a second radius sized to nest within the first radius.

15. A plate arrangement according to claim 8 in which the one marginal portion and the adjoining first and second marginal portions defining said end closures are rolled into a semicircle of a first radius and the other marginal portion and adjoining first and second marginal portions defining said end closures on the opposite side of the midline are rolled into a semicircle of a second radius sized to nest within the marginal portions of the first radius, the second and third plates being mirror images of the first plate, with the one marginal portion and adjoining first and second marginal portions being formed with the second radius and the other marginal portion and adjoining first and second marginal portions being formed with the first radius.

16. A plate arrangement according to claim 8, in which the complementary first and second marginal portions of adjacent plates are rolled into semicircles of different radii, the first radius sized to nest within the second radius so that the nested marginal portions interlock to form said end closures between the plates, the end closures having an outer convex shape and an inner concave shape to minimize turbulence of air flowing between the plates and against the interlocked marginal portions.

* * * * *

UNITED STATES PATENT AND TRADEMARK OFFICE

CERTIFICATE OF CORRECTION

PATENT NO. : 4,556,105

DATED : December 3, 1985

INVENTOR(S) : ALAN H. BONER

It is certified that error appears in the above-identified patent and that said Letters Patent is hereby corrected as shown below:

Column 2, line 68, "outer" should be --other--;

Column 3, line 52, "contaminates" should be --contaminants--;

Column 4, line 55, "contaminats" should be --contaminants--;

Column 4, line 62, "Th" should be --The--;

Column 7, line 18, "th" should be --the--;

Column 7, line 31, "not" should be --now--;

Column 7, line 57, "contacting" should be --contracting--.

Signed and Sealed this

*Eighteenth* Day of *February 1986*

[SEAL]

*Attest:*

*Attesting Officer*

DONALD J. QUIGG

*Commissioner of Patents and Trademarks*